United States Patent [19]

Schmidt

[11] 4,322,288

[45] Mar. 30, 1982

[54] APPARATUS FOR SIZING PARTICULATE MATERIAL

[76] Inventor: Willibald Schmidt, Eichstätter St. 49, D-8432 Beilngries, Fed. Rep. of Germany

[21] Appl. No.: 230,007

[22] Filed: Jan. 30, 1981

[30] Foreign Application Priority Data

Apr. 23, 1980 [DE] Fed. Rep. of Germany ..... 3015665

[51] Int. Cl.[3] ..... B07B 1/04

[52] U.S. Cl. ..... 209/356; 209/240; 209/258; 209/316

[58] Field of Search ..... 209/356, 352, 353, 354, 209/240, 243, 255, 315, 316, 317, 355, 656, 657, 258, 262, 263–266

[56] References Cited

U.S. PATENT DOCUMENTS

| | | | |
|---|---|---|---|
| 620,014 | 2/1899 | Blacket | 209/458 X |
| 772,377 | 10/1904 | Rowland | 209/356 X |
| 940,212 | 11/1909 | Stone | 209/356 |
| 1,310,759 | 7/1919 | Lucas | 209/318 |
| 1,510,742 | 10/1924 | Gutleben | 209/255 X |
| 1,799,751 | 4/1931 | Johnson | 209/315 X |
| 2,592,917 | 4/1952 | Lockwood | 209/317 X |
| 2,901,109 | 8/1959 | Eppenberger | 209/316 |
| 3,016,203 | 1/1962 | Sears | 209/315 X |
| 3,302,788 | 2/1967 | Sackett | 209/355 |
| 3,719,277 | 3/1973 | Michael | 209/317 X |
| 3,752,315 | 8/1973 | Hubach | 209/317 X |

FOREIGN PATENT DOCUMENTS

| | | | |
|---|---|---|---|
| 569662 | 1/1929 | Fed. Rep. of Germany | 209/355 |
| 691834 | 5/1940 | Fed. Rep. of Germany | 209/316 |
| 846505 | 6/1952 | Fed. Rep. of Germany | 209/316 |
| 1055866 | 10/1953 | France | 209/36 |
| 683724 | 12/1952 | United Kingdom | 209/316 |

*Primary Examiner*—Robert Halper

*Attorney, Agent, or Firm*—Dann, Dorfman, Herrell and Skillman

[57] ABSTRACT

An apparatus for sizing or separating different types of particulate material such as grain, seeds and the like without the need for replacing the sizing screens includes a movable diverter disposed between upper and lower sets of screens. When the diverter is in a first position, material passing through a first sizing screen is directed to the top of a second sizing screen and material which has not passed through the first sizing screen is directed to a discharge pan. When the diverter is in a second position, material which has passed through the first sizing screen is directed toward a discharge pan and material which has not passsed through the first sizing screen is directed toward a second sizing screen.

4 Claims, 1 Drawing Figure

APPARATUS FOR SIZING PARTICULATE MATERIAL

BACKGROUND OF THE INVENTION

The present invention relates to an apparatus for classifying or sizing particulate material, particularly grain, seeds and the like.

In the known sizing or sorting devices of this general type, which also serve as seed dressers, the various sizing screens must be removed and replaced with screens having different size openings whenever the type of material to be sized or sorted is changed, in order to adjust the screen openings to the given material or to the specific purpose of sizing or sorting. During the harvesting period, the ripening of different grains which are to be sized or sorted by a single machine often coincides, for example, wheat and barley are often ripe and are harvested during the same general time period. In order to size or sort such different types of grains in the same prior art sorting devices, valuable time and manpower must be expended to continually change the removable sizing screens, thereby increasing costs and reducing the potential daily output of the sizing devices.

The present invention provides a particulate material sizing or sorting apparatus which can be quickly and conveniently adjusted for sizing a given particulate material without the costly and time-consuming removal and replacement of the sizing screens.

SUMMARY OF THE INVENTION

Briefly stated, the present invention provides an apparatus for sizing different types of particulate material such as grains, seeds and the like, without the need to replace the sizing screens. The apparatus comprises a first downwardly inclined sizing screen and a first discharge pan beneath and parallel to the first sizing screen. A second sizing screen with a second discharge pan disposed beneath and parallel to the second sizing screen, are located below the first discharge pan. The second sizing screen and second discharge pan are inclined downwardly in a direction opposite to the incline of the first sizing screen and discharge pan. A third discharge pan is disposed above and parallel to the second sizing screen. A movable diverter is disposed between the first sizing screen and discharge pan and the second sizing screen and discharge pan. When the diverter is in a first position, material from the lower end of the first sizing screen is directed to the top end of the third discharge pan and material from the lower end of the first discharge pan is directed to the top end of the second sizing screen. When the diverter is in a second position, material from the lower end of the first sizing screen is directed into a discharge opening, and material from the lower end of the first discharge pan is directed to the upper end of the second sizing screen.

BRIEF DESCRIPTION OF THE DRAWING

The foregoing summary, as well as the following detailed description of a preferred embodiment of the invention will be better understood when read in conjunction with the appended drawing, in which.

DESCRIPTION OF A PREFERRED EMBODIMENT

Figure 1:
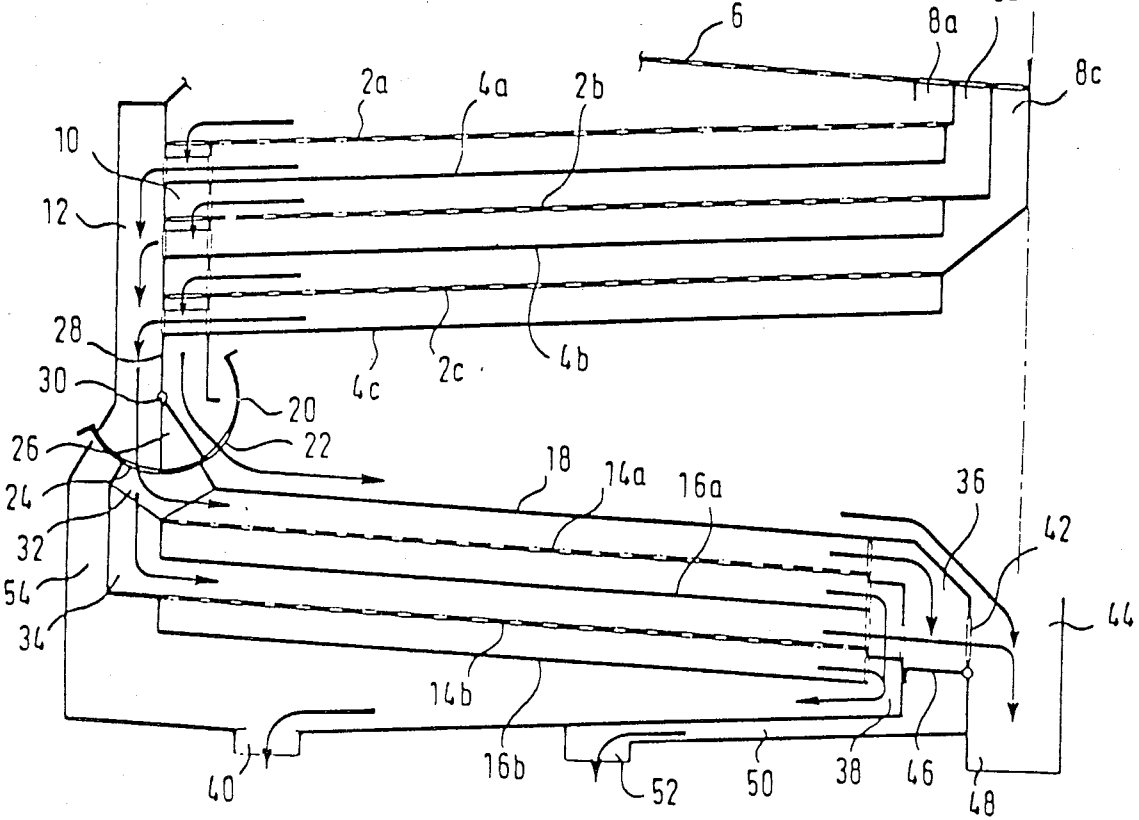
FIG. 1 is a sectional schematic view of a preferred embodiment of a sizing apparatus constructed in accordance with the present invention.

Referring to FIG. 1, there is shown a sizing or sorting apparatus in accordance with the present invention. The sorting apparatus has three first perforated floors or sizing screens 2*a*, 2*b*, and 2*c* inclined downwardly, under each of which is a parallel first discharge floor or pan 4*a*, 4*b* and 4*c*, respectively. Particulate material such as grain, seeds and the like to be sorted is fed to the upper or inlet ends of the sizing screens 2*a*, 2*b* and 2*c*, for example across a feeder screen 6 having discharge openings 8*a*, 8*b* and 8*c* leading to the inlet ends of the respective screens. The particulate material which does not pass through the perforations of sizing screens 2*a*, 2*b* and 2*c* runs off of the lower end of the sizing screens 2*a*, 2*b* and 2*c* and falls into a first vertical collecting conduit 10. The material which passes through the sizing screens 2*a*, 2*b* and 2*c* is received in the discharge pans 4*a*, 4*b* and 4*c*, is advanced by gravity across the pans and subsequently runs off or is discharged from the lower or outlet ends of the discharge pans 4*a*, 4*b* and 4*c* where it falls into a second vertical collecting conduit 12.

Below the first sizing screens 2*a*, 2*b* and 2*c* and the first discharge pans 4*a*, 4*b* and 4*c*, are two second sizing screens 14*a* and 14*b* having perforations with a diameter different from that of sizing screens 2*a*, 2*b* and 2*c*, and which are inclined downwardly in a direction opposite to that of the first sizing screens 2*a*, 2*b* and 2*c*. Beneath each of the second sizing screens 14*a* and 14*b* are two parallel second discharge pans 16*a* and 16*b*. Above and parallel to the sizing screen 14*a* there is a third discharge pan 18.

At the lower end of the collecting conduits 10 and 12 there is a generally curved collecting pan 20 in the shape of a trough, with two openings 22 and 24. Between the openings 22 and 24, the collecting pan 20 has a double partition 26 which, in this embodiment, is wedge-shaped. The partition 26 is hinged at 30 at the lower end of a common wall 28 between the two collecting conduits 10 and 12. The collecting pan 20, with its two openings 22 and 24 and with the partition 26, forms a first movable diverter.

With the diverter in a first position as shown in FIG. 1, particulate material falling from the collecting conduit 10 passes through opening 22 and onto the third discharge pan 18. Similarly, particulate material falling from the collecting conduit 12 passes through opening 24 and onto sizing screens 14*a* and 14*b* via conduits 32 and 34, respectively.

Particulate material which does not pass through the sizing screens 14*a* and 14*b* runs off and is discharged from the lower or outlet ends of the sizing screens 14*a* and 14*b* and enters a third collecting conduit 36. Particulate material which passes through the sizing screens 14*a* and 14*b* falls into the discharge pans 16*a* and 16*b*, is discharged into a fourth collecting conduit 38 from the lower or outlet ends of the discharge pans 16*a* and 16*b*, and moves downwardly toward a first discharge opening 40.

The third collecting conduit 36 includes an opening 42 to a fifth collecting conduit 44 which receives the particulate material from the third discharge pan 18. The opening 42 may be closed by a movable flap 46, which can shut off the third collecting conduit 36 (as shown) so that the material running off from the sizing screens 14*a* and 14*b* can be fed, along with the material discharged from discharge pan 18, into the collecting conduit 44. Conduit 44 is connected to a second discharge opening 48. Alternatively, the flap 46 may be moved to close off opening 42, thereby allowing particulate material running off of the sizing screens 14*a* and 14*b* to be fed through a conduit 50 into a third discharge opening 52.

Figure 2:
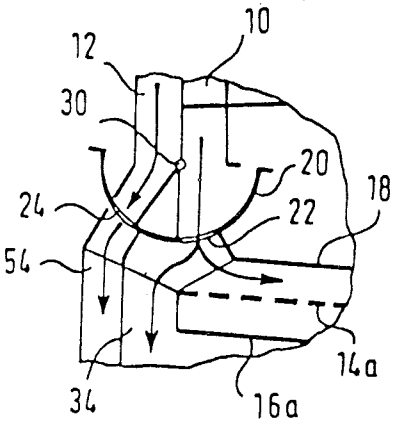
FIG. 2 is a view of a portion of FIG. 1 with the diverter in a different position.

When the first diverter is in a second position, as shown in FIG. 2, the material coming from the collecting conduit 12 passes through opening 24 and into a conduit 54 where it proceeds into the discharge opening 40. The material falling from the collecting conduit 10 passes through opening 22 and onto the sizing screens 14*a* and 14*b*.

As an example, the first sizing screens 2*a*, 2*b* and 2*c* may have a hole opening of 2.5 mm (for barley), and the second sizing screens 14*a* and 14*b* may have a hole opening of 2 to 2.2 mm (for wheat). Consequently, it is possible to size either barley or wheat, as desired without changing screens merely by changing the position of the first diverter.

The two diverters may be adjusted manually or by means of a pneumatic or hydraulic cylinder.

In the position of the first diverter 20, as is shown in FIG. 2, the first sizing screens 2*a*, 2*b* and 2*c* and the second sizing screens 14*a* and 14*b* are connected in series, which implies a considerable increase in the overall screen surface. The coarse material first passes over the screens 2*a*, 2*b* or 2*c*, separating the fine material therefrom, and then passes over the screens 14*a* or 14*b* to separate any residual fine material. All of the coarse material is discharged through the outlet 48 if the second diverter or flap 46 is in the illustrated position, or through the outlet 52 if the second diverter is in the other position.

When the first diverter is in the position of FIG. 1, on the other hand, the coarse material passing over the upper screens 2*a*, 2*b* and 2*c* is discharged through the outlet 48 without being subjected to further screening by screens 14*a* and 14*b*. The fine material which passes through the screens 2*a*, 2*b* and 2*c* is subjected to further classification by the screens 14*a* and 14*b*. The coarse material is discharged through outlet 48 or outlet 52 depending on the position of the flap diverter 46.

From the foregoing description, it can be seen that the present invention comprises an apparatus for classifying or sizing particulate material which can be quickly and conveniently adjusted for sizing or sorting a given particulate material without the costly and time-consuming removal and replacement of sizing screens. It will recognized by those skilled in the art that changes or modifications may be made to the above-described embodiment without departing from the broad inventive concepts of the invention. It is understood therefore that this invention is not limited to the particular embodiment disclosed, but it is intended to cover all modifications which are within the scope and spirit of the invention as defined by the appended claims.

I claim:

1. An apparatus for sizing particulate material comprising:

a first downwardly inclined sizing screen;

a first collecting conduit for receiving material from the surface of said first sizing screen;

a first discharge pan disposed beneath said first sizing screen to receive, advance and discharge material passing through said first screen;

a second collecting conduit for receiving material from the first discharge pan;

a second sizing screen downwardly inclined in an opposite direction from and disposed below said first discharge pan;

a second discharge pan disposed beneath said second sizing screen to receive, advance and discharge material passing through said second screen;

a third discharge pan disposed above said second sizing screen operable to receive, advance and discharge material independently of said second screen;

a discharge opening disposed below said second discharge pan; and a first movable diverter disposed between the first and third discharge pans for receiving and diverting material from the first and second collecting conduits, the first diverter diverting material from the first collecting conduit to the upper end of the third discharge pan and material from the second collecting conduit to the upper end of the second sizing screen when the diverter is in a first position and diverting material from the first collecting conduit to the upper end of the second sizing screen and material from the second collecting conduit to the discharge opening when the diverter is in a second position.

2. The apparatus as recited in claim 1 further including a third collecting conduit for receiving material from the surface of the second sizing screen, a fourth collecting conduit for receiving material from the third discharge pan, and a second movable diverter disposed below the second sizing screen for receiving and diverting material from the third and fourth collecting conduits, the second diverter diverting material from the third collecting conduit to combine with material from the fourth collecting conduit when the second diverter is in a first position and diverting material from the third collecting conduit separately from material from the fourth collecting conduit when the second diverter is in a second position.

3. The apparatus as recited in claim 1 wherein each first and second discharge pans are respectively parallel to the first and second sizing screens.

4. The apparatus as recited in claim 1 wherein the first sizing screen has a greater size hole opening than the second sizing screen.

* * * * *